US009325116B2

(12) United States Patent
Yokoyama et al.

(10) Patent No.: US 9,325,116 B2
(45) Date of Patent: Apr. 26, 2016

(54) CONNECTOR ASSEMBLY

(71) Applicant: JAPAN AVIATION ELECTRONICS INDUSTRY, LIMITED, Shibuya-ku, Tokyo (JP)

(72) Inventors: Yohei Yokoyama, Tokyo (JP); Takeshi Shindo, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 85 days.

(21) Appl. No.: 14/230,984

(22) Filed: Mar. 31, 2014

(65) Prior Publication Data

US 2014/0322960 A1 Oct. 30, 2014

(30) Foreign Application Priority Data

Apr. 25, 2013 (JP) ..... 2013-092302

(51) Int. Cl.
*H01R 13/64* (2006.01)
*H01R 24/62* (2011.01)
*H01R 27/00* (2006.01)

(52) U.S. Cl.
CPC ..... *H01R 13/64* (2013.01); *H01R 24/62* (2013.01); *H01R 27/00* (2013.01)

(58) Field of Classification Search
CPC . H01R 13/631; H01R 13/629; H01R 13/6471
USPC ..... 439/374, 218, 660
See application file for complete search history.

(56) References Cited

U.S. PATENT DOCUMENTS 5,876,248 A * 3/1999 Brunker ..... H01R 23/688 439/607.08
6,623,308 B2 9/2003 Ono
6,733,343 B2 5/2004 Morita et al.
6,776,660 B1 8/2004 Kubota et al.
6,981,887 B1 * 1/2006 Mese ..... H01R 24/62 439/244
7,094,089 B2 * 8/2006 Andre ..... H01R 12/7088 439/218
8,198,563 B2 6/2012 Tsai

FOREIGN PATENT DOCUMENTS

| | | | |
|---|---|---|---|
| CN | 2793957 | Y | 7/2006 |
| CN | 201708384 | U | 1/2011 |
| CN | 202749615 | U | 2/2013 |
| JP | 2002-008753 | A | 1/2002 |
| JP | 2002-203641 | A | 7/2002 |
| JP | 2003-031316 | A | 1/2003 |
| JP | 2003-217728 | A | 7/2003 |
| JP | 2008-210674 | A | 9/2008 |
| JP | 3176945 | U | 7/2012 |
| TW | 201037917 | A | 10/2010 |

OTHER PUBLICATIONS

Chinese Office Action (and English translation thereof) dated Dec. 29, 2015, issued in counterpart Chinese Application No. 201410162820.0.

* cited by examiner

*Primary Examiner* — Xuong Chung Trans
(74) *Attorney, Agent, or Firm* — Holtz, Holtz & Volek PC

(57) ABSTRACT

A connector assembly comprises a first connector and a second connector. The second connector is mateable with the first connector under any one of a normal state and a reversed state. The first connector comprises a first guide portion and a second guide portion while the second connector comprises a first normal guided-portion, a second normal guided-portion, a first reversed guided-portion and a second reversed guided-portion. When the second connector is mated with the first connector under the normal state, the first normal guided-portion and the second normal guided-portion are guided by the first guide portion and the second guide portion, respectively. When the second connector is mated with the first connector under the reversed state, the first reversed guided-portion and the second reversed guided-portion are guided by the first guide portion and the second guide portion, respectively.

10 Claims, 8 Drawing Sheets

CONNECTOR ASSEMBLY

CROSS REFERENCE TO RELATED APPLICATIONS

An applicant claims priority under 35 U.S.C. §119 of Japanese Patent Application No. JP2013-092302 filed Apr. 25, 2013.

BACKGROUND OF THE INVENTION

This invention relates to a connector assembly comprising two connectors mateable with each other.

For example, this type of connector is disclosed in each of U.S. Pat. No. 6,776,660 (Patent Document 1) and JP-U 3176945 (Patent Document 2), contents of which are incorporated herein by reference.

Referring to FIG. 14, Patent Document 1 discloses a connector assembly comprising a receptacle 910 and a plug 920. The receptacle 910 comprises a shell 912 and two guide rails 914. The shell 912 has an upper surface 912U and a lower surface 912L. Each of the guide rails 914 is formed by bending a part of the upper surface 912U of the shell 912 downward. The plug 920 has an upper surface 920U and a lower surface 920L. The upper surface 920U of the plug 920 is formed with two ditches 924. The ditches 924 correspond to the guide rails 914, respectively. The plug 920 is mateable with the receptacle 910 only under a normal state where the guide rails 914 are guided by the ditches 924, respectively. When the plug 920 is urged to be mated with the receptacle 910 under a reversed state where the plug 920 is upside down, the guide rails 914 interfere with the plug 920. Accordingly, the plug 920 is prevented from being mated with the receptacle 910 under the reversed state.

Referring to FIGS. 15 and 16, Patent Document 2 discloses a connector assembly 950 comprising a USB receptacle 930 and a USB plug 940. The USB receptacle 930 comprises a plate-like portion 932. The USB receptacle 930 is formed with an upper space located over the plate-like portion 932 and a lower space located under the plate-like portion 932. The USB plug 940 comprises a plastic base 942. The plastic base 942 is insertable in each of the upper space and the lower space. The USB plug 940 is mateable with the USB receptacle 930 not only under a normal state where the plastic base 942 is inserted in the upper space but also under a reversed state where the USB plug 940 is upside down and the plastic base 942 is inserted in the lower space.

For example, a portable electronic apparatus has a connector to be used to receive electric power. This connector is mateable with a connector of a charging cable. In order to improve usability, it is preferable that the connector of the portable electronic apparatus is mateable with the connector of the charging cable not only under a normal state where the connector of the charging cable is in a normal posture but also under a reversed state where the connector of the charging cable is front side back relative to the normal posture. As for another example, a digital photo frame has a connector to be used to receive electric power similar to the portable electronic apparatus. Generally, the digital photo frame is placeable on a cradle which has a connector. When the digital photo frame is placed on the cradle, the connector of the cradle is mated with the connector of the digital photo frame. When the digital photo frame is placed on the cradle, a screen of the digital photo frame is preferred to face forward. Accordingly, it is preferable that the connector of the digital photo frame is mateable with the connector of the cradle only under a normal state where the screen faces forward.

As can be seen from the aforementioned examples, there is a case where it is preferable that a mating connector is mateable with a connector not only when the mating connector is in a normal state but also when the mating connector is in a reversed state. On the other hand, there is another case where it is preferable that a mating connector is mateable with a connector only when the mating connector is in a normal state. Thus, it is preferable that a connector is configured to allow a predetermined mating connector to be mated therewith under any one of a normal state and a reversed state while allowing another predetermined mating connector to be mated therewith only under another normal state. In other words, it is preferable that a connector assembly comprised the thus configured connector.

However, it is difficult to obtain a connector assembly configured as described above by modifying the existing connector assembly as disclosed in each of Patent Document 1 and Patent Document 2.

SUMMARY OF THE INVENTION

It is therefore an object of the present invention to provide a connector assembly comprising a connector which allows a predetermined mating connector to be mated therewith under any one of a normal state and a reversed state while allowing another predetermined mating connector to be mated therewith only under another normal state.

One aspect (first aspect) of the present invention provides a connector assembly comprising a first connector and a second connector. The second connector is mateable with the first connector along a front-rear direction under a normal state while mateable with the first connector along the front-rear direction also under a reversed state. The second connector under the reversed state is upside down relative to the second connector under the normal state in an up-down direction perpendicular to the front-rear direction. The first connector comprises a plate-like portion, a first upper contact, a first lower contact, a first guide portion and a second guide portion. The plate-like portion extends in a left-right direction perpendicular to both the front-rear direction and the up-down direction. The first upper contact is located at an upper portion of the plate-like portion. The first lower contact is located at a lower portion of the plate-like portion. The first guide portion and the second guide portion are apart from each other in the left-right direction. The second connector comprises a receive portion, a second upper contact, a second lower contact, a first normal guided-portion, a second normal guided-portion, a first reversed guided-portion and a second reversed guided-portion. The receive portion receives the plate-like portion when the second connector is mated with the first connector. The second upper contact is located at an upper portion of the receive portion. The second lower contact is located at a lower portion of the receive portion. The first normal guided-portion and the second normal guided-portion are apart from each other in the left-right direction. The first reversed guided-portion and the second reversed guided-portion are apart from each other in the left-right direction. When the second connector is mated with the first connector under the normal state, the first normal guided-portion and the second normal guided-portion are guided by the first guide portion and the second guide portion, respectively, and the second upper contact and the second lower contact are connected to the first upper contact and the first lower contact, respectively. When the second connector is mated with the first connector under the reversed state, the first reversed guided-portion and the second reversed guided-portion are guided by the first guide portion and the second guide portion, respectively, and the second upper contact and the second lower contact are connected to the first lower contact and the first upper contact, respectively.

Another aspect (second aspect) of the present invention provides a connector assembly comprising the first connector of the connector assembly of the first aspect and a third connector. The third connector is mateable with the first connector along a front-rear direction under a normal state while not mateable with the first connector under a reversed state. The third connector under the reversed state is upside down relative to the third connector under the normal state in an up-down direction perpendicular to the front-rear direction. The third connector comprises a receive portion, a third upper contact, a third lower contact, a third normal guided-portion, a fourth normal guided-portion and a third prevent portion. The receive portion of the third connector receives the plate-like portion when the third connector is mated with the first connector. The third upper contact is located at an upper portion of the receive portion of the third connector. The third lower contact is located at a lower portion of the receive portion of the third connector. The third normal guided-portion and the fourth normal guided-portion are apart from each other in a left-right direction perpendicular to both the front-rear direction and the up-down direction. When the third connector is mated with the first connector under the normal state, the third normal guided-portion and the fourth normal guided-portion are guided by the first guide portion and the second guide portion, respectively, and the third upper contact and the third lower contact are connected to the first upper contact and the first lower contact, respectively. An abutment of the third prevent portion with the first guide portion prevents the third connector from being mated with the first connector under the reversed state.

Still another aspect (third aspect) of the present invention provides the connector assembly which is the connector assembly of the first aspect and further comprises a third connector. The third connector is mateable with the first connector along a front-rear direction under a normal state while not mateable with the first connector under a reversed state. The third connector under the reversed state is upside down relative to the third connector under the normal state in an up-down direction perpendicular to the front-rear direction. The third connector comprises a receive portion, a third upper contact, a third lower contact, a third normal guided-portion, a fourth normal guided-portion and a third prevent portion. The receive portion of the third connector receives the plate-like portion when the third connector is mated with the first connector. The third upper contact is located at an upper portion of the receive portion of the third connector. The third lower contact is located at a lower portion of the receive portion of the third connector. The third normal guided-portion and the fourth normal guided-portion are apart from each other in a left-right direction perpendicular to both the front-rear direction and the up-down direction. When the third connector is mated with the first connector under the normal state, the third normal guided-portion and the fourth normal guided-portion are guided by the first guide portion and the second guide portion, respectively, and the third upper contact and the third lower contact are connected to the first upper contact and the first lower contact, respectively. An abutment of the third prevent portion with the first guide portion prevents the third connector from being mated with the first connector under the reversed state.

An appreciation of the objectives of the present invention and a more complete understanding of its structure may be had by studying the following description of the preferred embodiment and by referring to the accompanying drawings.

Figure 1:
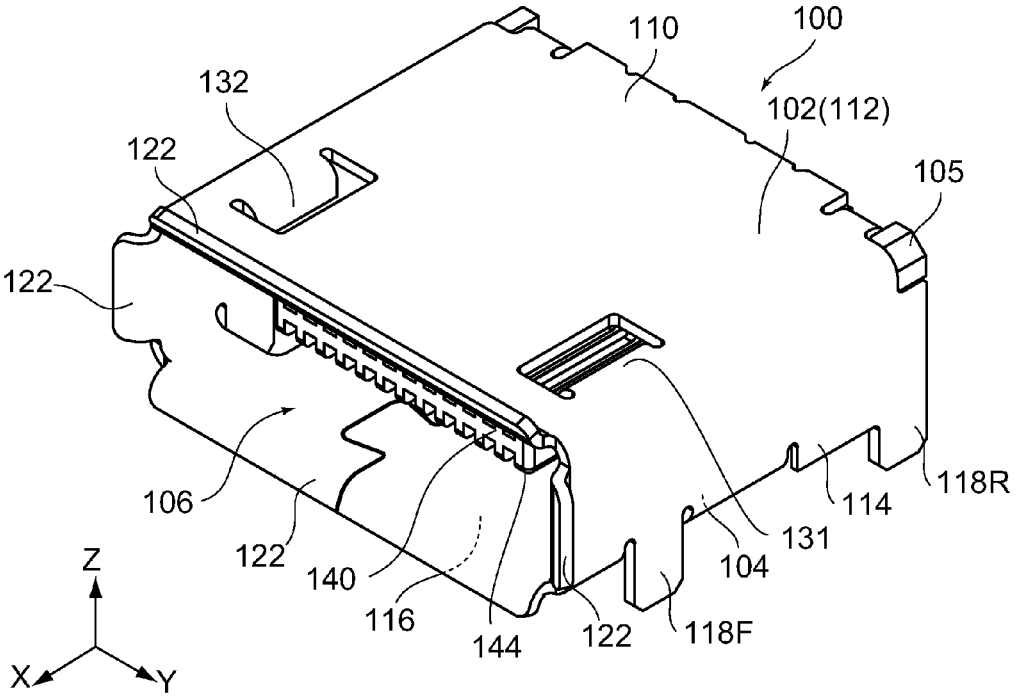
FIG. 1 is a perspective view showing a first connector of a connector assembly according to a first embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

First Embodiment

Figure 5:
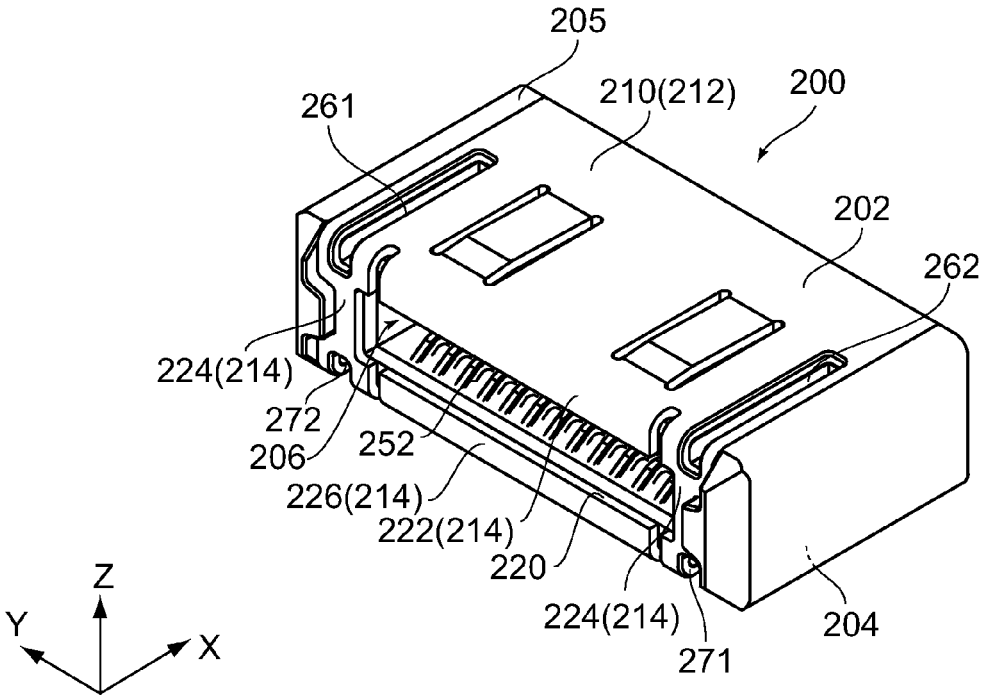
FIG. 5 is a perspective view showing a second connector of the connector assembly according to the first embodiment of the present invention.
Figure 9:
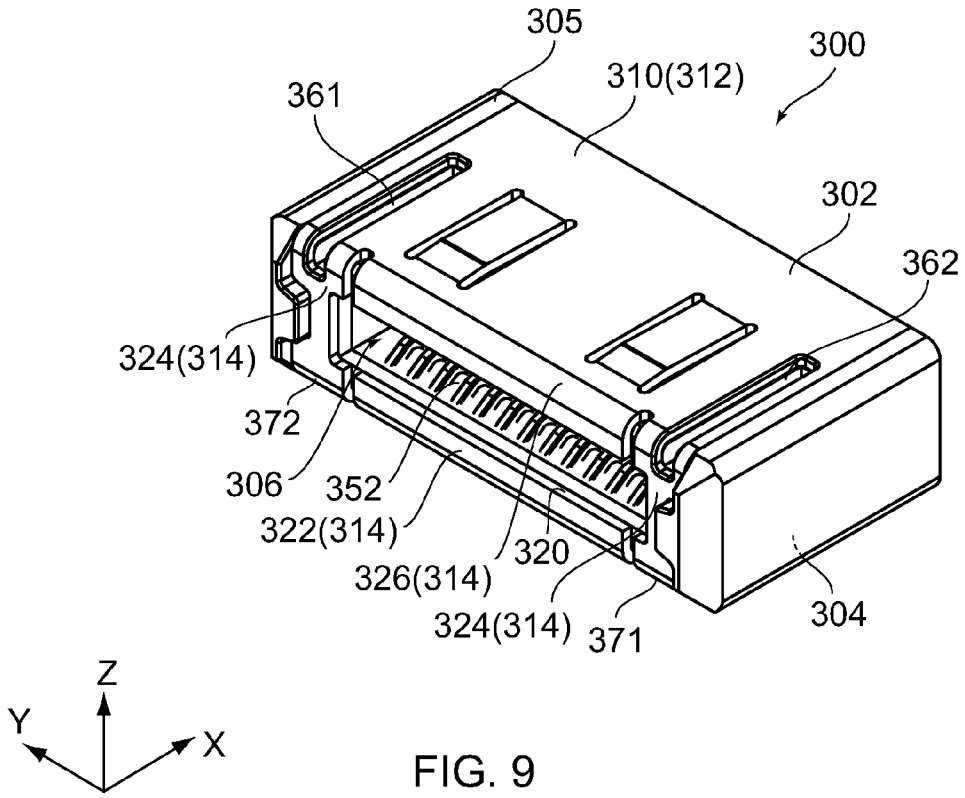
FIG. 9 is a perspective view showing a third connector of the connector assembly according to the first embodiment of the present invention.

Referring to FIGS. 1, 5 and 9, a connector assembly according to a first embodiment of the present invention comprises a first connector 100 (see FIG. 1), a second connector 200 (see FIG. 5) and a third connector 300 (see FIG. 9). However, the connector assembly may not comprise one of the second connector 200 and the third connector 300. The first connector 100 according to the present embodiment is a receptacle which is installed in, for example, a portable electronic apparatus. The second connector 200 is mateable with the first connector 100 along a front-rear direction (X-direction). In detail, the second connector 200 has an upper portion 202 and a lower portion 204 which are opposite to each other in an up-down direction (Z-direction) perpendicular to the front-rear direction (X-direction). The second connector 200 can be placed in a normal state where the upper portion 202 faces upward (see FIG. 5). The second connector 200 can be placed also in a reversed state where the lower portion 204 faces upward. The second connector 200 under the reversed state is upside down relative to the second connector 200 under the normal state in the up-down direction (Z-direction). The second connector 200 is mateable with the first connector 100 under the normal state while mateable with the first connector 100 also under the reversed state. The third connector 300 has an upper portion 302 and a lower portion 304 which are opposite to each other in the up-down direction (Z-direction). The third connector 300 can be placed in another normal state where the upper portion 302 faces upward (see FIG. 9). The third connector 300 can be placed also in another reversed state where the lower portion 304 faces upward. The third connector 300 under the reversed state is upside down relative to the third connector 300 under the normal state in the up-down direction (Z-direction). The third connector 300 is mateable with the first connector 100 along the front-rear direction (X-direction) under the normal state while not mateable with the first connector 100 under the reversed state.

As shown in FIGS. 1 to 4, the first connector 100 according to the present embodiment has an upper portion 102 and a lower portion 104. In the present embodiment, the first connector 100 is mounted on and fixed to a circuit board (not shown) under a state where the upper portion 102 faces upward. The first connector 100 according to the present embodiment comprises a housing 105, a shell 110, a plurality of upper contacts (first upper contacts) 151 and a plurality of lower contacts (first lower contacts) 152. The shell 110 covers the housing 105.

The housing 105 has a plate-like portion 140. The plate-like portion 140 is covered by the shell 110 in a plane perpendicular to the front-rear direction (X-direction). The plate-like portion 140 protrudes forward (in the positive X-direction) and extends in a left-right direction (Y-direction) perpendicular to both the front-rear direction (X-direction) and the up-down direction (Z-direction). The plate-like portion 140 has an upper portion 142 and a lower portion 144. The upper portion 142 holds and fixes the upper contacts 151. The lower portion 144 holds and fixes the lower contacts 152. Thus, the upper contacts 151 are located at the upper portion 142 while the lower contacts 152 are located at the lower portion 144. The first connector 100 according to the present embodiment has an accommodation space 106. The accommodation space 106 according to the present embodiment is a space formed between the plate-like portion 140 and the shell 110 (see FIGS. 2 and 4). As described later, the accommodation space 106 accommodates the second connector 200 or the third connector 300 which is mated with the first connector 100.

The shell 110 has an upper portion 112, two side portions 114 and a lower portion 116. The first connector 100 is formed with an opening 120 which is surrounded by the upper portion 112, the side portions 114 and the lower portion 116. The opening 120 is located in the vicinity of a front end (positive X-side end) of the shell 110. When the first connector 100 is mated with each of the second connector 200 (see FIG. 5) and the third connector 300 (see FIG. 9), each of the second connector 200 and the third connector 300 is inserted into the opening 120. The shell 110 has four guide flares 122. The guide flares 122 are formed of front end portions (positive X-side end portions) of the upper portion 112, the side portions 114 and the lower portion 116. When the first connector 100 is mated with each of the second connector 200 and the third connector 300, the guide flares 122 guide each of the second connector 200 and the third connector 300 toward the opening 120. Moreover, the shell 110 has two leg portions 118F and two leg portions 118R. The leg portions 118F are formed at front sides (positive X-sides) of the side portions 114, respectively. The leg portions 118R are formed at rear sides (negative X-sides) of the side portions 114, respectively. The first connector 100 is fixed to the circuit board (not shown) by the leg portions 118F and the leg portions 118R.

Figure 2:
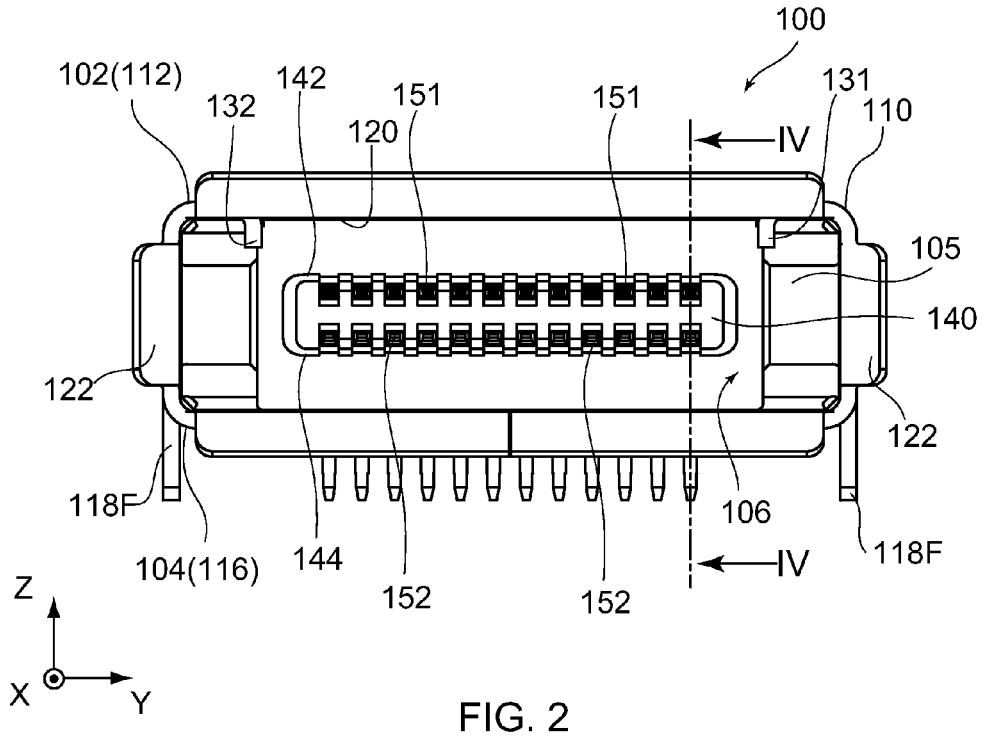
FIG. 2 is a front view showing the first connector of FIG. 1.
Figure 3:
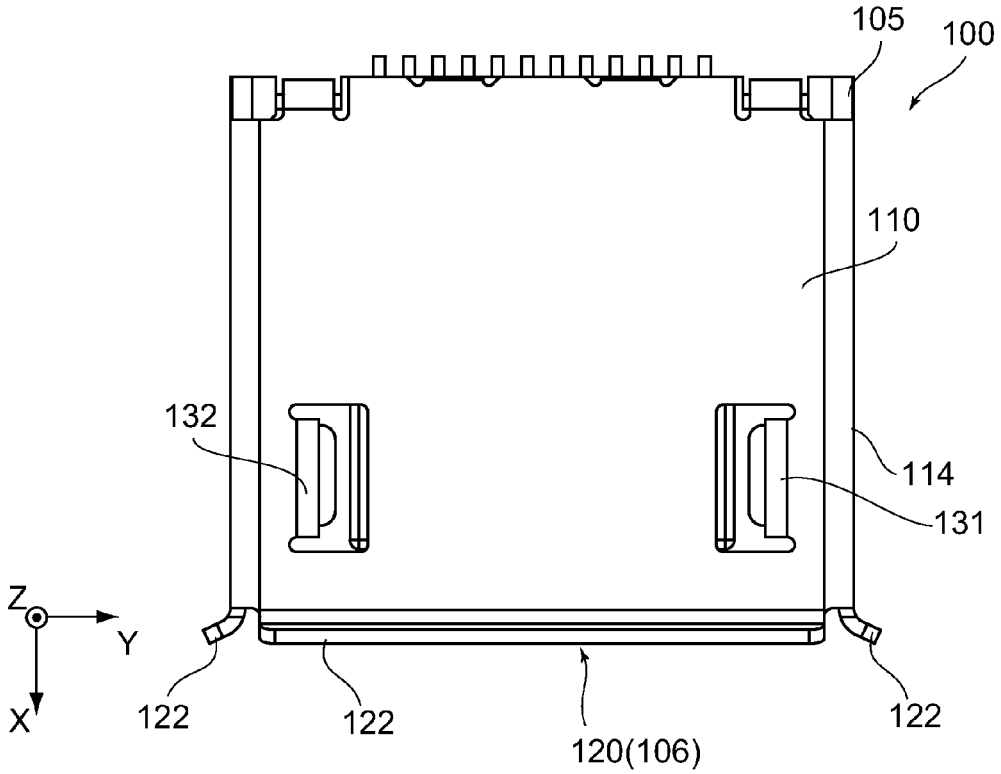
FIG. 3 is a top view showing the first connector of FIG. 1.
Figure 4:
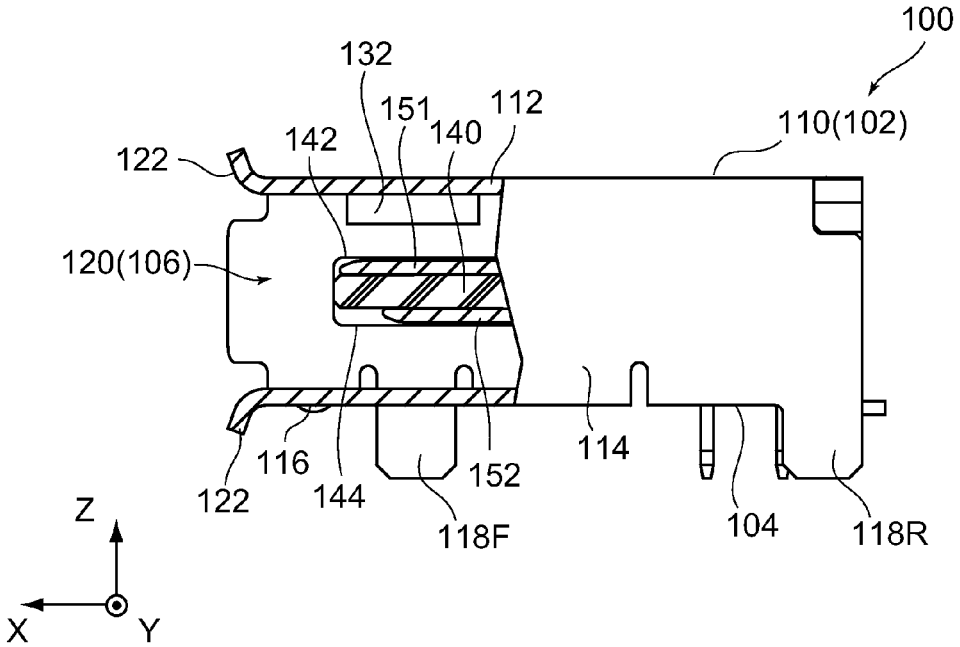
FIG. 4 is a partially cutaway side view showing the first connector of FIG. 2, partially cut away along line IV-IV.

The first connector 100 according to the present embodiment comprises a single first guide portion (guide rail) 131 and a single second guide portion (guide rail) 132. The guide rail 131 and the guide rail 132 are formed at the upper portion 112 of the shell 110. The guide rail 131 and the guide rail 132 are apart from each other in the left-right direction (Y-direction). In detail, the upper portion 112 is formed with two pieces each of which is partially cut from the upper portion 112 by a cut of an angular U-like shape. Each of the pieces has a rectangular shape. Each of the guide rail 131 and the guide rail 132 is formed by bending the piece (i.e. a part of the shell 110) downward. The guide rail 131 and the guide rail 132 protrude downward from the upper portion 102 of the first connector 100 (see FIG. 1). As shown in FIGS. 2 to 4, the guide rail 131 and the guide rail 132 extend in the accommodation space 106 along the front-rear direction (X-direction). Each of the guide rail 131 and the guide rail 132 according to the present embodiment is a part of the shell 110. However, each of the guide rail 131 and the guide rail 132 may be formed of a member other than the shell 110.

As shown in FIGS. 5 to 8, the second connector 200 according to the present embodiment has an upper portion 202 and a lower portion 204. As previously described, the second connector 200 is mateable with the first connector 100 not only when the second connector 200 is in the normal state but also when the second connector 200 is in the reversed state. When the second connector 200 is mated with the first connector 100 under the normal state, the upper portion 102 and the lower portion 104 of the first connector 100 face the upper portion 202 and the lower portion 204 of the second connector 200, respectively. When the second connector 200 is mated with the first connector 100 under the reversed state, the upper portion 102 and the lower portion 104 of the first connector 100 face the lower portion 204 and the upper portion 202 of the second connector 200, respectively. The second connector 200 according to the present embodiment comprises a housing 205, a shell 210, a plurality of upper contacts (second upper contacts) 251 and a plurality of lower contacts (second lower contacts) 252. The shell 210 partially covers the housing 205.

Figure 6:
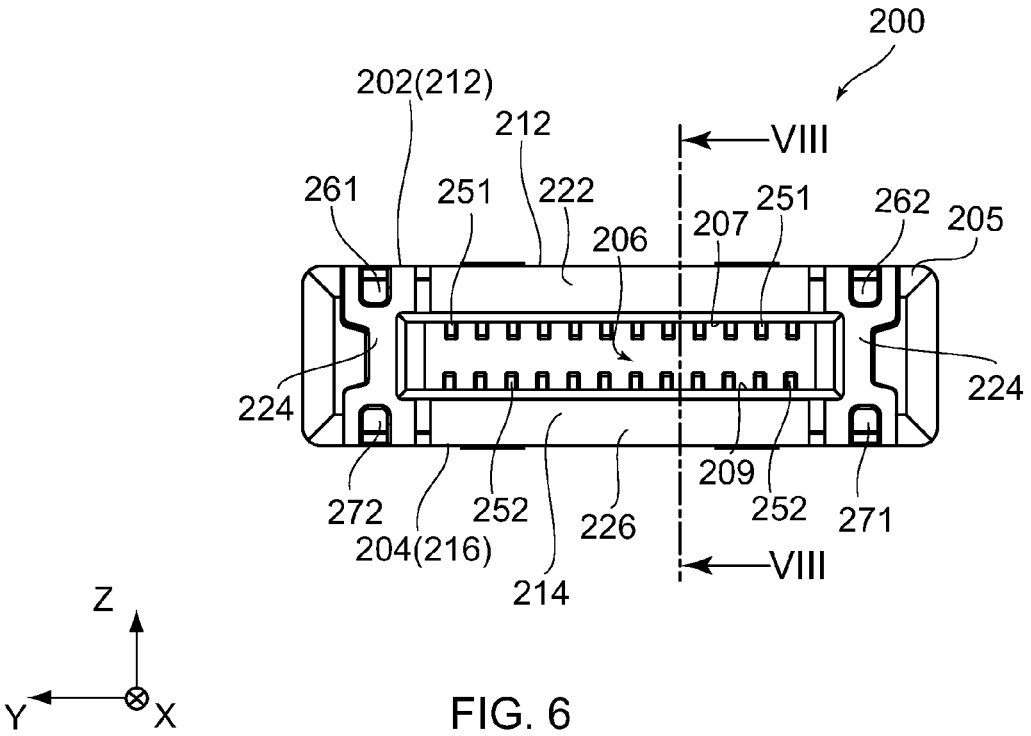
FIG. 6 is a front view showing the second connector of FIG. 5.
Figure 7:
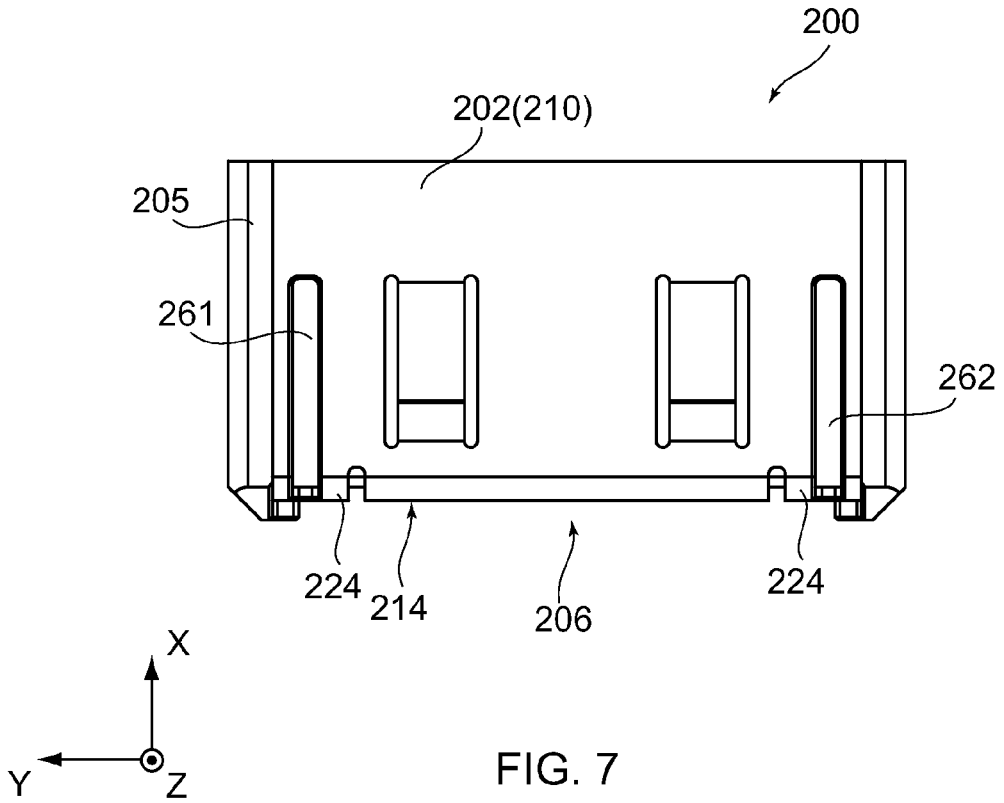
FIG. 7 is a top view showing the second connector of FIG. 5.
Figure 8:
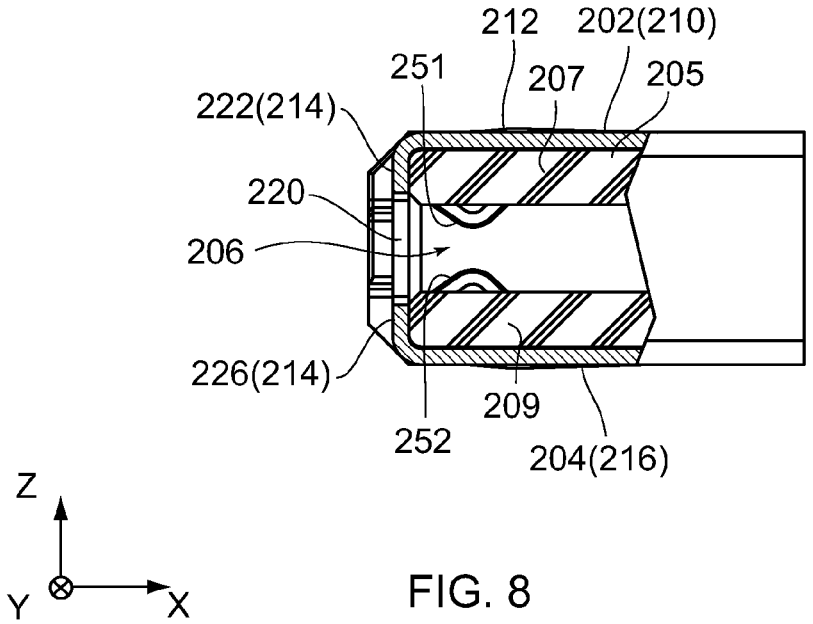
FIG. 8 is a partially cutaway side view showing the second connector of FIG. 6, partially cut away along line VIII-VIII.

The housing 205 has a receive portion 206. The receive portion 206 receives the plate-like portion 140 (see FIG. 2) of the first connector 100 when the second connector 200 is mated with the first connector 100. As shown in FIGS. 6 and 8, the receive portion 206 has an upper portion 207 and a lower portion 209. The upper portion 207 holds and fixes the upper contacts 251. The lower portion 209 holds and fixes the lower contacts 252. Thus, the upper contacts 251 are located at the upper portion 207 while the lower contacts 252 are located at the lower portion 209.

The shell 210 has an upper portion 212, a front portion 214 and a lower portion 216. The second connector 200 is formed with an opening 220. The opening 220 is located at the front portion 214 of the shell 210. In detail, the front portion 214 has an upper portion 222, two side portions 224 and a lower portion 226. The upper portion 222 extends downward (along the negative Z-direction) from the upper portion 212. The side portions 224 couple the upper portion 212 and the lower portion 216 with each other in the up-down direction (Z-direction). The lower portion 226 extends upward (along the positive Z-direction) from the lower portion 216. The opening 220 is surrounded by the upper portion 222, the side portions 224 and the lower portion 226.

The second connector 200 according to the present embodiment comprises a single first normal guided-portion (ditch) 261, a single second normal guided-portion (ditch) 262, a single first reversed guided-portion (ditch) 271 and a single second reversed guided-portion (ditch) 272. The ditch 261 and the ditch 262 are formed at the upper portion 202 of the second connector 200. The ditch 271 and the ditch 272 are formed at the lower portion 204 of the second connector 200. The ditch 261 and the ditch 262 are apart from each other in the left-right direction (Y-direction). The ditch 271 and the ditch 272 are also apart from each other in the left-right direction (Y-direction). A distance in the left-right direction (Y-direction) between the ditch 261 and the ditch 262 is equal to a distance in the left-right direction (Y-direction) between the guide rail 131 and the guide rail 132 of the first connector 100 (see FIG. 2). A distance in the left-right direction (Y-direction) between the ditch 271 and the ditch 272 is also equal to the distance in the left-right direction (Y-direction) between the guide rail 131 and the guide rail 132 of the first connector 100 (see FIG. 2). According to the present embodiment, each of the ditch 261 and the ditch 262 is a ditch which is formed at the upper portion 207 of the receive portion 206 while each of the ditch 271 and the ditch 272 is another ditch which is formed at the lower portion 209 of the receive portion 206. In detail, the housing 205 according to the present embodiment has four recesses. Two of the recesses are formed at an upper surface of the housing 205 while remaining two of the recesses are formed at a lower surface of the housing 205. Parts of the shell 210, which correspond to the respective recesses, are cut away so that the ditch 261, the ditch 262, the ditch 271 and the ditch 272 are formed. The ditch 261 and the ditch 262 according to the present embodiment are recessed toward the lower portion 204 of the second connector 200 and extend rearward (along the positive X-direction) from the front portion 214 of the shell 210. The ditch 271 and the ditch 272 are recessed toward the upper portion 202 of the second connector 200 and extend rearward (along the positive X-direction) from the front portion 214 of the shell 210. As can be seen from FIG. 6, a midpoint of an imaginary line which connects the ditch 261 with the ditch 271 is a midpoint of another imaginary line which connects the ditch 262 with the ditch 272. Thus, the ditch 261 and the ditch 271 are arranged in discrete rotational symmetry of the second order, with respect to a predetermined axis which extends parallel to the front-rear direction (X-direction) and which passes through a point that is a midpoint of the second connector 200 in the left-right direction (Y-direction) and is also a midpoint of the second connector 200 in the up-down direction (Z-direction). Similarly, the ditch 262 and the ditch 272 are arranged in discrete rotational symmetry of the second order, with respect to the predetermined axis.

As can be seen from FIGS. 1, 2, 5 and 6, when the second connector 200 is inserted into the first connector 100 under the normal state where the upper portion 202 of the second connector 200 faces upward, the ditch 261 and the ditch 262 of the second connector 200 are guided by the guide rail 131 and the guide rail 132 of the first connector 100, respectively, so that the second connector 200 is mated with the first connector 100 under the normal state. Accordingly, the accommodation space 106 accommodates the receive portion 206 of the second connector 200, and the upper contact 251 and the lower contact 252 of the second connector 200 are connected to the upper contact 151 and the lower contact 152 of the first connector 100, respectively. Moreover, when the second connector 200 is inserted into the first connector 100 under the reversed state where the lower portion 204 of the second connector 200 faces upward, the ditch 271 and the ditch 272 of the second connector 200 are guided by the guide rail 131 and the guide rail 132 of the first connector 100, respectively, so that the second connector 200 is mated with the first connector 100 under the reversed state. Accordingly, the accommodation space 106 accommodates the receive portion 206 of the second connector 200, and the upper contact 251 and the lower contact 252 of the second connector 200 are connected to the lower contacts 152 and the upper contacts 151 of the first connector 100, respectively. When the second connector 200 is mated with the first connector 100 under the reversed state, the ditch 271 and the ditch 272 are located at positions where the ditch 261 and the ditch 262 are located upon the mating of the second connector 200 with the first connector 100 under the normal state. Accordingly, the guide rail 131 and the guide rail 132 do not interfere with the second connector 200 not only when the second connector 200 is mated with the first connector 100 under the normal state but also when the second connector 200 is mated with the first connector 100 under the reversed state.

Figure 10:
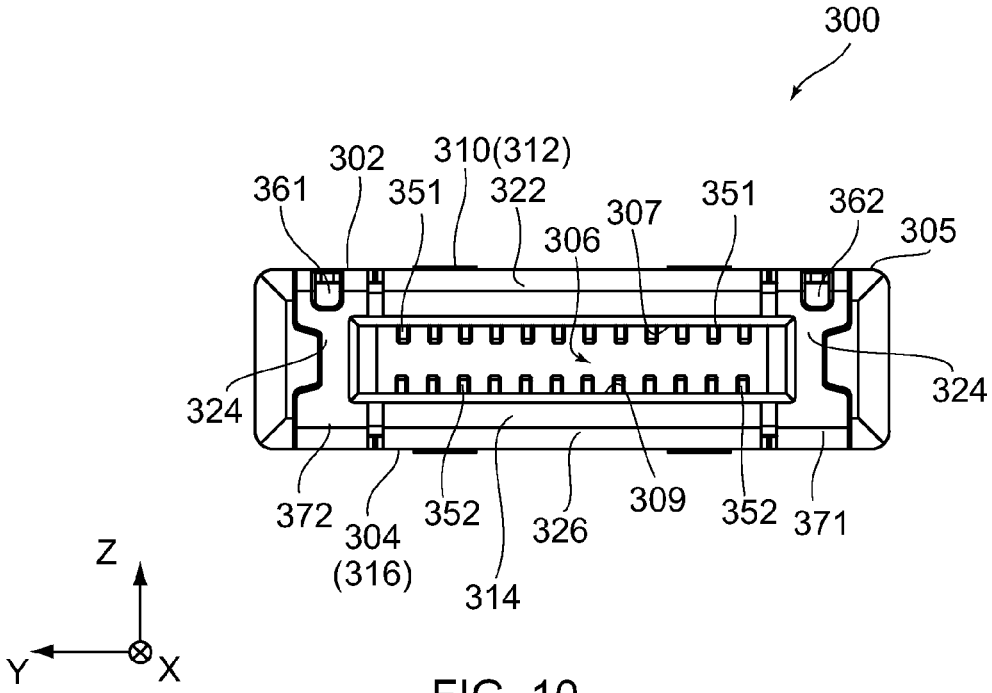
FIG. 10 is a front view showing the third connector of FIG. 9.

As can be seen from FIGS. 5, 9 and 10, the third connector 300 according to the present embodiment configured similar to the second connector 200 except that the third connector 300 does not comprise portions similar to the ditch 271 and the ditch 272 of the second connector 200. In detail, similar to the second connector 200, the third connector 300 has an upper portion 302 and a lower portion 304. Moreover, similar to the second connector 200, the third connector 300 comprises a housing 305, a shell 310, a plurality of upper contacts (third upper contacts) 351 and a plurality of lower contacts (third lower contacts) 352. The shell 310 partially covers the housing 305. The housing 305 has a receive portion 306. Similar to the receive portion 206 of the second connector 200, the receive portion 306 receives the plate-like portion 140 (see FIG. 2) of the first connector 100 when the third connector 300 is mated with the first connector 100. The receive portion 306 has an upper portion 307 and a lower portion 309. The upper portion 307 holds and fixes the upper contacts 351. The lower portion 309 holds and fixes the lower contacts 352. Thus, the upper contacts 351 are located at the upper portion 307 while the lower contacts 352 are located at the lower portion 309. The shell 310 has an upper portion 312, a front portion 314 and a lower portion 316. The front portion 314 has an upper portion 322, two side portions 324 and a lower portion 326. The third connector 300 is formed with an opening 320. The opening 320 is configured similar to the opening 220 of the second connector 200.

The third connector 300 comprises a single third normal guided-portion (ditch) 361, a single fourth normal guided-portion (ditch) 362, a single third prevent portion (abutment portion) 371 and a single fourth prevent portion (abutment portion) 372. The ditch 361 and the ditch 362 are formed at positions corresponding to the ditch 261 and the ditch 262 of the second connector 200, respectively. The ditch 361 and the ditch 362 are apart from each other in the left-right direction (Y-direction). The abutment portion 371 and the abutment portion 372 are formed at positions corresponding to the ditch 271 and the ditch 272 of the second connector 200, respectively. The abutment portion 371 and the abutment portion 372 are apart from each other in the left-right direction (Y-direction).

As can be seen from FIGS. 1, 2, 9 and 10, when the third connector 300 is inserted into the first connector 100 under the normal state where the upper portion 302 of the third connector 300 faces upward, the ditch 361 and the ditch 362 of the third connector 300 are guided by the guide rail 131 and the guide rail 132 of the first connector 100, respectively, so that the third connector 300 is mated with the first connector 100 under the normal state. Accordingly, the accommodation space 106 accommodates the receive portion 306 of the third connector 300, and the upper contact 351 and the lower contact 352 of the third connector 300 are connected to the upper contact 151 and the lower contact 152 of the first connector 100, respectively. On the other hand, each of the abutment portion 371 and the abutment portion 372 prevents the third connector 300 from being mated with the first connector 100 under the reversed state. In detail, if the third connector 300 is urged to be inserted into the first connector 100 under the reversed state where the lower portion 304 of the third connector 300 faces upward, the abutment portion 371 and the abutment portion 372 of the third connector 300 are brought into abutment and interfere with the guide rail 131 and the guide rail 132 of the first connector 100. Accordingly, the third connector 300 is prevented from being mated with the first connector 100 under the reversed state so that the upper contact 351 and the lower contact 352 of the third connector 300 are not connected to the lower contact 152 and the upper contact 151 of the first connector 100.

Each of the abutment portion 371 and the abutment portion 372 according to the present embodiment is formed of a part of the housing 305 and a part of the shell 310. However, each of the abutment portion 371 and the abutment portion 372 may be formed of a member other than the shell 310, provided that the members are brought into abutment with the guide rail 131 and the guide rail 132 to prevent the third connector 300 from moving forward (along the positive X-direction) when the third connector 300 is urged to be mated with the first connector 100 under the reversed state. In other words, it is sufficient that the third connector 300 has a member for interference which is located at a position corresponding to the ditch 271 or the ditch 272 of the second connector 200.

As described above, the first connector 100 according to the present embodiment allows the second connector 200 to be mated therewith under any one of the normal state and the reversed state while allowing the third connector 300 to be mated therewith only under the normal state. In other words, the first connector 100 is selectively mateable with each of the second connector 200 under the normal state and the third connector 300 under the normal state. However, the first connector 100 is mateable with the second connector 200 under the reversed state while not mateable with the third connector 300 under the reversed state. Thus, the third connector 300 is mateable with the first connector 100 only under the normal state. Accordingly, an electronic apparatus having the third connector 300 is not necessary to comprise detection means (control means) which detects whether the third connector 300 is mated with the first connector 100 under the normal state or the reversed state. It is therefore possible to largely reduce the manufacturing cost of the electronic apparatus.

Second Embodiment

Figure 11:
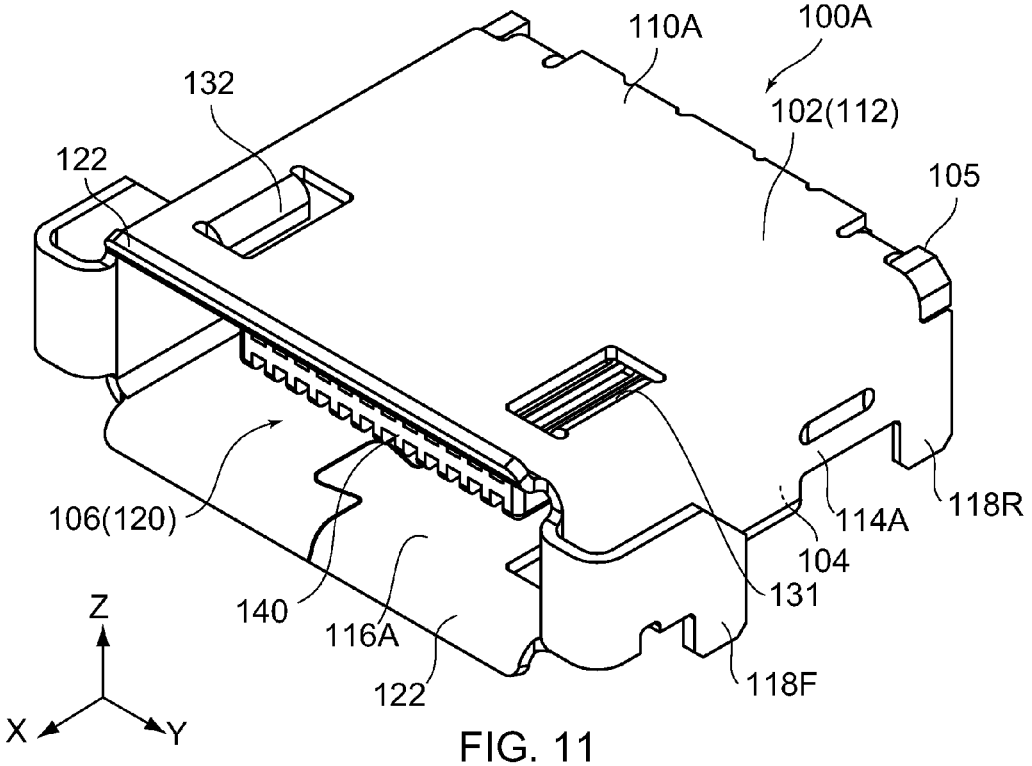
FIG. 11 is a perspective view showing a first connector of a connector assembly according to a second embodiment of the present invention.
Figure 12:
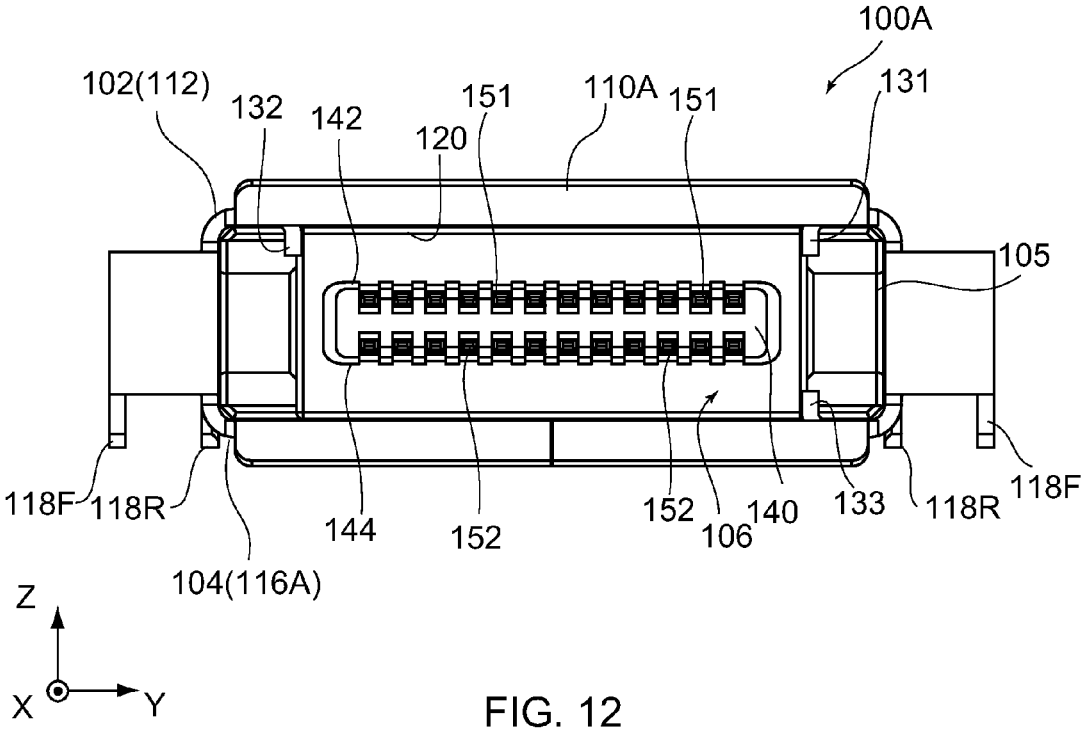
FIG. 12 is a front view showing the first connector of FIG. 11.
Figure 13:
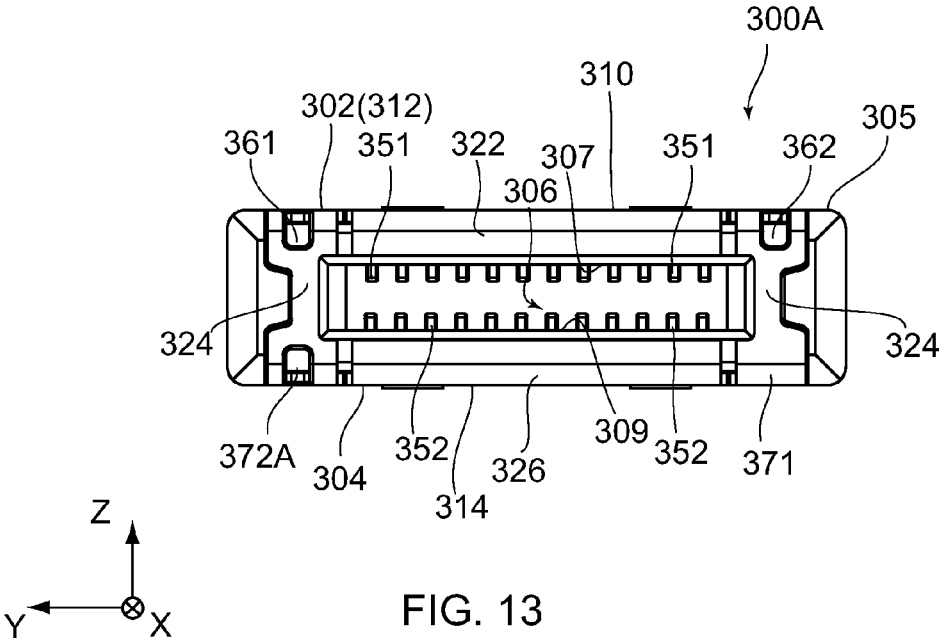
FIG. 13 is a front view showing a third connector of the connector assembly according to the second embodiment of the present invention.
Figure 14:
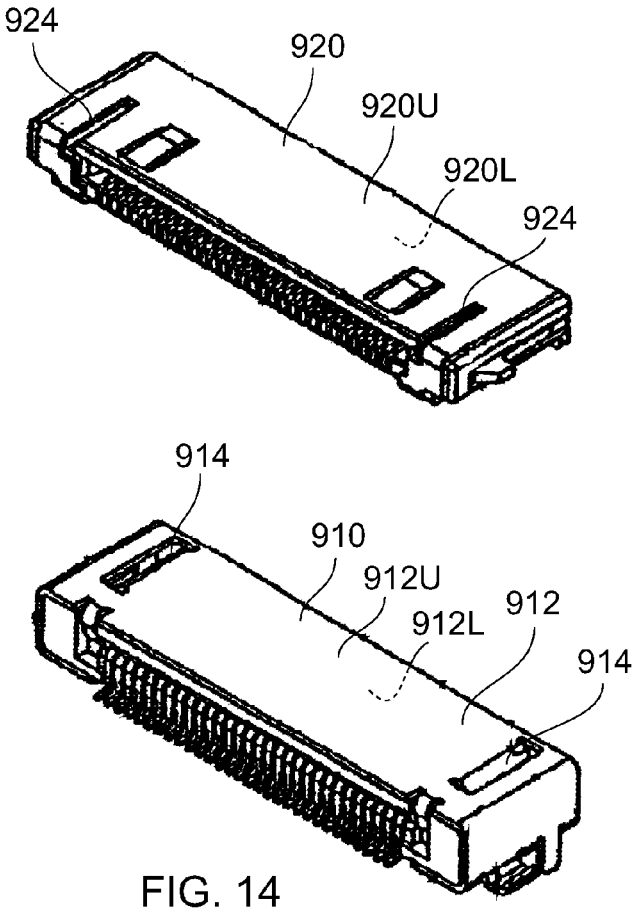
FIG. 14 PRIOR ART
FIG. 14 is a perspective view showing a connector assembly of Patent Document 1.

As shown in FIGS. 5, 11 and 13, a connector assembly according to a second embodiment of the present invention, similar to the first embodiment, comprises a first connector 100A (see FIG. 11) the second connector 200 (see FIG. 5) and a third connector 300A (see FIG. 13). However, similar to the first embodiment, the connector assembly may comprise the first connector 100A and at least one of the second connector 200 and the third connector 300A. The second connector 200 is mateable with the first connector 100A along the front-rear direction (X-direction) under any one of the normal state and the reversed state. The third connector 300A is mateable with the first connector 100A along the front-rear direction (X-direction) under a normal state while not mateable with the first connector 100A under a reversed state where the third connector 300A is upside down relative to the third connector 300A under the normal state in the up-down direction (Z-direction). As can be seen from FIGS. 11 and 12, the first connector 100A according to the present embodiment is configured similar to the first connector 100 (see FIG. 1) according to the first embodiment except that the first connector 100A comprises a single third guide portion (guide rail) 133. Accordingly, in the following explanation, the portions which are same as those of the first connector 100 are referred by using same reference signs same as those of the first connector 100, and explanation about the same portions are not made.

As shown in FIGS. 11 and 12, the first connector 100A comprises a shell 110A which is partially different from the shell 110 (see FIG. 1). Specifically, the shell 110A has two side portions 114A and a lower portion 116A. Each of the side portions 114A is folded back at a front end thereof to be formed with a leg portion 118F. As shown in FIG. 12, the lower portion 116A is formed with a single piece (i.e. a part of the shell 110A) which is partially cut from the lower portion 116A by a cut of an angular U-like shape. The piece has a rectangular shape. The piece is bent upward so that the guide rail 133 is formed. Thus, the first connector 100A comprises the guide rail 133 in addition to the guide rail 131 and the guide rail 132. As shown in FIG. 12, the guide rail 133 according to the present embodiment protrudes upward from the lower portion 104 of the first connector 100A. The guide rail 133 extends in the accommodation space 106 along the front-rear direction (X-direction). Similar to the guide rail 131 and the guide rail 132, the guide rail 133 according to the present embodiment is a part of the shell 110A. However, the guide rail 133 may be formed of a member other than the shell 110A.

As can be seen from FIG. 13, the third connector 300A according to the present embodiment is configured similar to the third connector 300 (see FIG. 9) according to the first embodiment except that the third connector 300A comprises a single fifth normal guided-portion (ditch) 372A instead of the abutment portion 372. Accordingly, in the following explanation, the portions which are same as those of the third connector 300 are referred by using same reference signs same as those of the third connector 300, and explanation about the same portions are not made. As shown in FIG. 13, the upper portion 302 of the third connector 300A is provided with the ditch 361 and the ditch 362 while the lower portion 304 is provided with the abutment portion 371 and the ditch 372A. Similar to the ditch 361 and the ditch 362, the ditch 372A is a ditch formed in the housing 305 and the shell 310. The ditch 372A is recessed toward the upper portion 302 of the third connector 300 and extends rearward (along the positive X-direction) from the front portion 314 of the shell 310. The abutment portion 371 and the ditch 372A are apart from each other in the left-right direction (Y-direction).

As can be seen from FIGS. 5, 6, 11 and 12, when the second connector 200 is mated with the first connector 100A under the normal state, the ditch 261, the ditch 262 and the ditch 272 of the second connector 200 are guided by the guide rail 131, the guide rail 132 and the guide rail 133, respectively. When the second connector 200 is mated with the first connector 100A under the reversed state, the ditch 271, the ditch 272 and the ditch 262 of the second connector 200 are guided by the guide rail 131, the guide rail 132 and the guide rail 133, respectively. Thus, when the second connector 200 is mated with the first connector 100A, one of the ditch 272 and the ditch 262 is guided by the guide rail 133.

As can be seen from FIGS. 11 to 13, when the third connector 300A is mated with the first connector 100A under the normal state, the ditch 361, the ditch 362 and ditch 372A are guided by the guide rail 131, the guide rail 132 and the guide rail 133, respectively. On the other hand, if the third connector 300A is urged to be inserted into the first connector 100A under the reversed state where the lower portion 304 of the third connector 300A faces upward, the abutment portion 371 of the third connector 300A is brought into abutment and interferes with the guide rail 131 of the first connector 100A. Accordingly, the third connector 300A is prevented from being mated with the first connector 100A under the reversed state.

Figure 15:
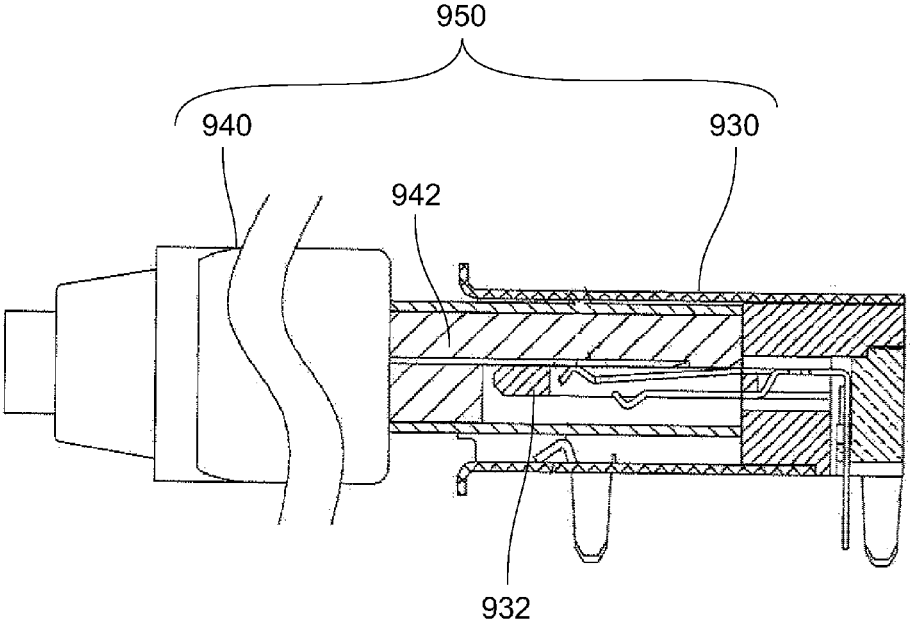
FIG. 15 PRIOR ART
FIG. 15 is a cross-sectional view showing a connector assembly of Patent Document 2.
Figure 16:
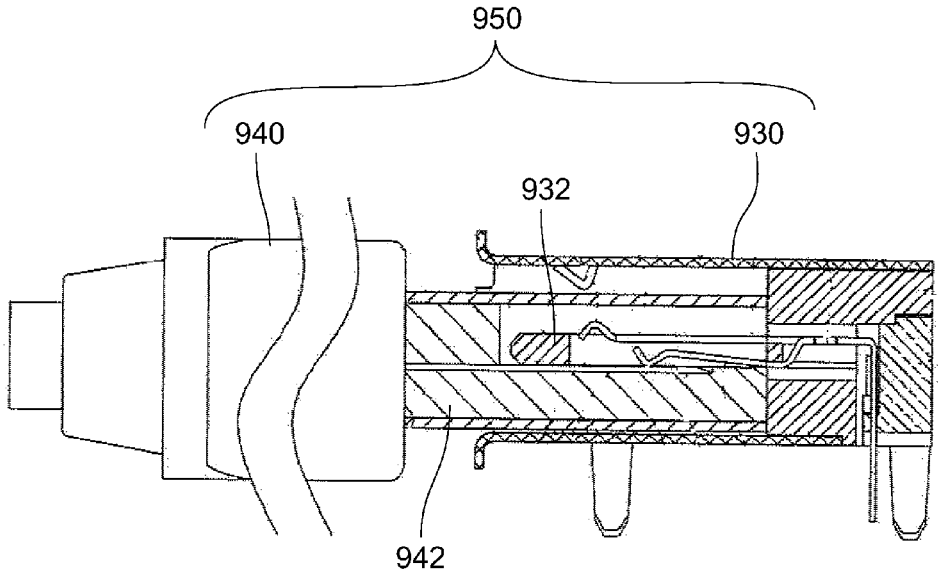
FIG. 16 PRIOR ART
FIG. 16 is another cross-sectional view showing the connector assembly of Patent Document 2.

As can be seen from FIGS. 15 and 16, although the USB receptacle 930 of the connector assembly 950 of Patent Document 2 has two contact rows, only one of the contact rows is used when the USB plug 940 is mated with the USB receptacle 930. On the other hand, each of the connectors according to the aforementioned embodiments has two contact rows, and two of the contact rows are used when the connector is mated with the mating connector. Thus, the connector assembly according to the present invention is connectable to a cable having multiple cores.

The present application is based on a Japanese patent application of JP2013-092302 filed before the Japan Patent Office on Apr. 25, 2013, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising:

a first connector; and a second connector, wherein:

the second connector is mateable with the first connector along a front-rear direction under both a normal state and a reversed state, the second connector under the reversed state being upside down relative to the second connector under the normal state in an up-down direction perpendicular to the front-rear direction;

the first connector comprises a plate-like portion, a first upper contact, a first lower contact, a first guide portion, and a second guide portion;

the plate-like portion extends in a left-right direction perpendicular to both the front-rear direction and the up-down direction;

the first upper contact is located at an upper portion of the plate-like portion;

the first lower contact is located at a lower portion of the plate-like portion;

the first guide portion and the second guide portion are apart from each other in the left-right direction;

the second connector comprises a receive portion, a second upper contact, a second lower contact, a first normal guided-portion, a second normal guided-portion, a first reversed guided-portion, and a second reversed guided-portion;

the receive portion receives the plate-like portion when the second connector is mated with the first connector;

the second upper contact is located at an upper portion of the receive portion;

the second lower contact is located at a lower portion of the receive portion;

the first normal guided-portion and the second normal guided-portion are apart from each other in the left-right direction;

the first reversed guided-portion and the second reversed guided-portion are apart from each other in the left-right direction;

each of the first normal guided-portion and the second normal guided-portion is a ditch which is formed at the upper portion of the receive portion of the second connector;

each of the first reversed guided-portion and the second reversed guided-portion is another ditch which is formed at the lower portion of the receive portion of the second connector;

when the second connector is mated with the first connector under the normal state, the first normal guided-portion and the second normal guided-portion are guided by the first guide portion and the second guide portion, respectively, and the second upper contact and the second lower contact are connected to the first upper contact and the first lower contact, respectively; and when the second connector is mated with the first connector under the reversed state, the first reversed guided-portion and the second reversed guided-portion are guided by the first guide portion and the second guide portion, respectively, and the second upper contact and the second lower contact are connected to the first lower contact and the first upper contact, respectively.

2. The connector assembly as recited in claim 1, wherein:

the first connector has an accommodation space;

the accommodation space accommodates the receive portion of the second connector when the second connector is mated with the first connector;

the first guide portion and the second guide portion protrude downward from an upper portion of the first connector and extend in the accommodation space along the front-rear direction;

the first normal guided-portion and the second normal guided-portion extend along the front-rear direction; and the first reversed guided-portion and the second reversed guided-portion extending along the front-rear direction.

3. The connector assembly as recited in claim 1, wherein a midpoint of an imaginary line which connects the first normal guided-portion with the first reversed guided-portion is a midpoint of another imaginary line which connects the second normal guided-portion with the second reversed guided-portion.

4. The connector assembly as recited in claim 1, wherein:

the first connector comprises a shell;

the shell covers the plate-like portion; and each of the first guide portion and the second guide portion is formed by bending a part of the shell downward.

5. The connector assembly as recited in claim 1, wherein:

the first connector has an accommodation space;

the accommodation space accommodates the receive portion of the second connector when the second connector is mated with the first connector;

the first connector further comprises a third guide portion;

the third guide portion protrudes upward from a lower portion of the first connector and extends in the accommodation space along the front-rear direction;

when the second connector is mated with the first connector under the normal state, the second reversed guided-portion is guided by the third guide portion; and when the second connector is mated with the first connector under the reversed state, the second normal guided-portion is guided by the third guide portion.

6. The connector assembly as recited in claim 1, further comprising a third connector, wherein:

the third connector is mateable with the first connector along a front-rear direction under a normal state and is not mateable with the first connector under a reversed state, the third connector under the reversed state being upside down relative to the third connector under the normal state in an up-down direction perpendicular to the front-rear direction;

the third connector comprises a receive portion, a third upper contact, a third lower contact, a third normal guided-portion, a fourth normal guided-portion, and a prevent portion;

the receive portion of the third connector receives the plate-like portion when the third connector is mated with the first connector;

the third upper contact is located at an upper portion of the receive portion of the third connector;

the third lower contact is located at a lower portion of the receive portion of the third connector;

the third normal guided-portion and the fourth normal guided-portion are apart from each other in a left-right direction perpendicular to both the front-rear direction and the up-down direction;

when the third connector is mated with the first connector under the normal state, the third normal guided-portion and the fourth normal guided-portion are guided by the first guide portion and the second guide portion, respectively, and the third upper contact and the third lower contact are connected to the first upper contact and the first lower contact, respectively; and an abutment of the prevent portion with the first guide portion prevents the third connector from being mated with the first connector under the reversed state.

7. A connector assembly comprising:

a first connector; and a second connector, wherein:

the second connector is mateable with the first connector along a front-rear direction under a normal state and is not mateable with the first connector under a reversed state, the second connector under the reversed state being upside down relative to the second connector under the normal state in an up-down direction perpendicular to the front-rear direction;

the first connector comprises a plate-like portion, a first upper contact, a first lower contact, a first guide portion, and a second guide portion;

the plate-like portion extends in a left-right direction perpendicular to both the front-rear direction and the up-down direction;

the first upper contact is located at an upper portion of the plate-like portion;

the first lower contact is located at a lower portion of the plate-like portion;

the first guide portion and the second guide portion are apart from each other in the left-right direction;

the second connector comprises a receive portion, a second upper contact, a second lower contact, a first normal guided-portion, a second normal guided-portion, and a prevent portion;

the receive portion of the second connector receives the plate-like portion when the second connector is mated with the first connector;

the second upper contact is located at an upper portion of the receive portion of the second connector;

the second lower contact is located at a lower portion of the receive portion of the second connector;

the first normal guided-portion and the second normal guided-portion are apart from each other in the left-right direction;

when the second connector is mated with the first connector under the normal state, the first normal guided-portion and the second normal guided-portion are guided by the first guide portion and the second guide portion, respectively, and the second upper contact and the second lower contact are connected to the first upper contact and the first lower contact, respectively; and an abutment of the prevent portion with the first guide portion prevents the second connector from being mated with the first connector under the reversed state.

8. The connector assembly as recited in claim 7, wherein:

the second connector further comprises another prevent portion;

the prevent portion and the other prevent portion are apart from each other in the left-right direction; and an abutment of the other prevent portion with the second guide portion also prevents the second connector from being mated with the first connector under the reversed state.

9. The connector assembly as recited in claim 7, wherein:

the first connector has an accommodation space;

the accommodation space accommodates the receive portion of the second connector when the second connector is mated with the first connector under the normal state;

the first connector further comprises a third guide portion;

the third guide portion protrudes upward from a lower portion of the first connector and extends in the accommodation space along the front-rear direction;

the second connector further comprises a third normal guided-portion;

the prevent portion and the third normal guided-portion are apart from each other in the left-right direction; and when the third connector is mated with the first connector under the normal state, the first normal guided-portion, the second normal guided-portion, and the third normal guided-portion are guided by the first guide portion, the second guide portion and the third guide portion, respectively, and the second upper contact and the second lower contact are connected to the first upper contact and the first lower contact, respectively.

10. A connector assembly comprising:

a first connector;

a second connector; and a third connector, wherein:

the second connector is mateable with the first connector along a front-rear direction under both a normal state and a reversed state, the second connector under the reversed state being upside down relative to the second connector under the normal state in an up-down direction perpendicular to the front-rear direction;

the first connector comprises a plate-like portion, a first upper contact, a first lower contact, a first guide portion, and a second guide portion;

the plate-like portion extends in a left-right direction perpendicular to both the front-rear direction and the up-down direction;

the first upper contact is located at an upper portion of the plate-like portion;

the first lower contact is located at a lower portion of the plate-like portion;

the first guide portion and the second guide portion are apart from each other in the left-right direction;

the second connector comprises a receive portion, a second upper contact, a second lower contact, a first normal guided-portion, a second normal guided-portion, a first reversed guided-portion and a second reversed guided-portion;

the receive portion receives the plate-like portion when the second connector is mated with the first connector;

the second upper contact is located at an upper portion of the receive portion;

the second lower contact is located at a lower portion of the receive portion;

the first normal guided-portion and the second normal guided-portion are apart from each other in the left-right direction;

the first reversed guided-portion and the second reversed guided-portion are apart from each other in the left-right direction;

when the second connector is mated with the first connector under the normal state, the first normal guided-portion and the second normal guided-portion are guided by the first guide portion and the second guide portion, respectively, and the second upper contact and the second lower contact are connected to the first upper contact and the first lower contact, respectively;

when the second connector is mated with the first connector under the reversed state, the first reversed guided-portion and the second reversed guided-portion are guided by the first guide portion and the second guide portion, respectively, and the second upper contact and the second lower contact are connected to the first lower contact and the first upper contact, respectively;

the third connector is mateable with the first connector along the front-rear direction under a normal state and is not mateable with the first connector under a reversed state, the third connector under the reversed state being upside down relative to the third connector under the normal state in the up-down direction;

the third connector comprises a receive portion, a third upper contact, a third lower contact, a third normal guided-portion, a fourth normal guided-portion, and a prevent portion;

the receive portion of the third connector receives the plate-like portion when the third connector is mated with the first connector;

the third upper contact is located at an upper portion of the receive portion of the third connector;

the third lower contact is located at a lower portion of the receive portion of the third connector;

the third normal guided-portion and the fourth normal guided-portion are apart from each other in the left-right direction;

when the third connector is mated with the first connector under the normal state, the third normal guided-portion and the fourth normal guided-portion are guided by the first guide portion and the second guide portion, respectively, and the third upper contact and the third lower contact are connected to the first upper contact and the first lower contact, respectively; and an abutment of the prevent portion with the first guide portion prevents the third connector from being mated with the first connector under the reversed state.

* * * * *